US007651002B2

(12) United States Patent
Hennemann et al.

(10) Patent No.: US 7,651,002 B2
(45) Date of Patent: Jan. 26, 2010

(54) CLOSURE CAP FOR A BOTTLE WITH CONTROLLED OPENING

(75) Inventors: Pascal Hennemann, Vaux les Saint Claude (FR); Philippe Lautre, Oyonnax (FR); Dominique Rusconi, Oyonnax (FR)

(73) Assignee: Plastohm S.A., Oyonnax (FR)

( * ) Notice: Subject to any disclaimer, the term of this patent is extended or adjusted under 35 U.S.C. 154(b) by 973 days.

(21) Appl. No.: 10/535,365

(22) PCT Filed: Dec. 4, 2003

(86) PCT No.: PCT/FR03/03595

§ 371 (c)(1),
(2), (4) Date: May 18, 2005

(87) PCT Pub. No.: WO2004/067399

PCT Pub. Date: Aug. 12, 2004

(65) Prior Publication Data

US 2006/0151416 A1 Jul. 13, 2006

(30) Foreign Application Priority Data

Dec. 31, 2002 (FR) ..... 02 16941

(51) Int. Cl.
*B65D 39/00* (2006.01)

(52) U.S. Cl. ..... 215/235; 215/305; 220/263; 220/323; 220/810; 222/556

(58) Field of Classification Search ..... 215/235, 215/237, 305; 220/263, 810, 323; 222/556
See application file for complete search history.

(56) References Cited

U.S. PATENT DOCUMENTS

| | | | | |
|---|---|---|---|---|
| 4,067,482 | A * | 1/1978 | Vogel et al. | 222/153.11 |
| 5,501,348 | A * | 3/1996 | Takeuchi | 215/235 |
| 5,573,127 | A * | 11/1996 | Takahashi et al. | 215/237 |
| 5,762,216 | A | 6/1998 | Takeuchi | |

FOREIGN PATENT DOCUMENTS

| | | |
|---|---|---|
| DE | 195 17 102 A1 | 11/1996 |
| DE | 200 00 604 U1 | 4/2000 |
| EP | 0 547 978 B1 | 7/1995 |
| EP | 0 819 615 A1 | 1/1998 |
| FR | 1.547.680 | 11/1968 |
| JP | 2000318755 | 11/2000 |

* cited by examiner

*Primary Examiner*—Anthony Stashick
*Assistant Examiner*—Elizabeth Volz
(74) *Attorney, Agent, or Firm*—Bachman & LaPointe, P.C.

(57) ABSTRACT

A closure device for a container, particularly a bottle, has a stopper called the service cap, arranged at the end thereof, on which a closing flap pivots. The closure device is provided with a locking system and cooperates with a hole in the sealed closure, or can be opened by pivoting. The closing flap has an opening device to guarantee the complete pivoting of the closing flap on opening, by a constant force and a constant movement without manual action of the user, immediately after the same has carried out a voluntary manual operation on the closing flap which is limited to releasing the locking system thereof.

5 Claims, 2 Drawing Sheets

CLOSURE CAP FOR A BOTTLE WITH CONTROLLED OPENING

BACKGROUND OF THE INVENTION (1) Field of the Invention

The present invention relates to a device for opening-closing a container, particularly a bottle, consisting of a stopper known as the "service cap" arranged at its end and to which there is articulated a shut-off flap.

This shut-off flap is equipped with an internal peg intended to collaborate in sealed closure with a pouring hole formed at the upper part of the stopper. This flap is intended to be made to open by flipping.

(2) Prior Art

In this type of device, the shut-off flap is made to open by direct action on one of the ends, the opposite end to the hinge, accompanying it by hand, generally using the thumb of the same hand, over at least part of its opening travel or until it reaches a flip-over point.

Whether this be in the first instance or in the second in the case of large stoppers, difficulties are encountered in accompanying the opening of the shut-off flap, particularly when one's hands are small.

The problem is that if the stopper is not fully open, it returns to an intermediate position, that is to say a position that is neither open nor closed, entailing a repeat of the operation on the shut-off flap in order to cause it to move past the flip-over point.

It is therefore necessary for the opening action to be continued until there is full opening, practically at 180° with respect to the upper plane of the stopper.

Of course, one could quite well hold the tube in one hand and perform the opening of the shut-off flap with the other hand, but the desired objective is to perform this operation with just one hand, the hand holding the bottle, while the thumb of the same hand in a single action opens the shut-off flap in a manner that is reliable and without the risk of the shut-off flap returning to its initial position.

SUMMARY OF THE INVENTION

According to a first phase of the inventive approach, due consideration was given to the fact that the locking of the shut-off flap on the stopper was achieved by the pressing of the shut-off pip into the pouring hole of the stopper, or by any other means, but that the problem with opening arose after the travel of disengaging the said pip from the hole had been completed.

Means were therefore sought which, starting out from such a shut-off and closure-locking system, would allow said shut-off flap to open, that is to say to complete its opening travel, automatically, without being manually accompanied by the user.

To this end, the invention relates to a device for opening-closing a container, particularly a bottle, consisting of a stopper known as the "service cap" arranged at its end and to which there is articulated a shut-off flap equipped with a locking system and which is intended to collaborate in sealed closure with a hole formed at the upper part of the stopper or be made to open by flipping, characterized in that the shut-off flap comprises controlled-opening means intended to cause the shut-off flap to flip over fully during opening, with a force of constant magnitude, and a constant movement, without manual accompaniment on the part of the user, immediately after this user has exerted a deliberate manual action on the shut-off flap that is confined to releasing its locking system.

In this way, opening of the shut-off flap takes place independently of the force required to unlock the locking system and makes it possible to obtain accompaniment for opening, without intervention on the part of the user, and always with the same force.

The present invention also relates to the features that will become apparent during the course of the description which will follow and which should be considered in isolation or in any technically feasible combination is thereof.

BRIEF DESCRIPTION OF THE DRAWINGS

This description, given by way of nonlimiting example, will make it easier to understand how the invention may be embodied with reference to the attached drawings, in which.

DETAILED DESCRIPTION OF THE PREFERRED EMBODIMENT(S)

Figure 1:
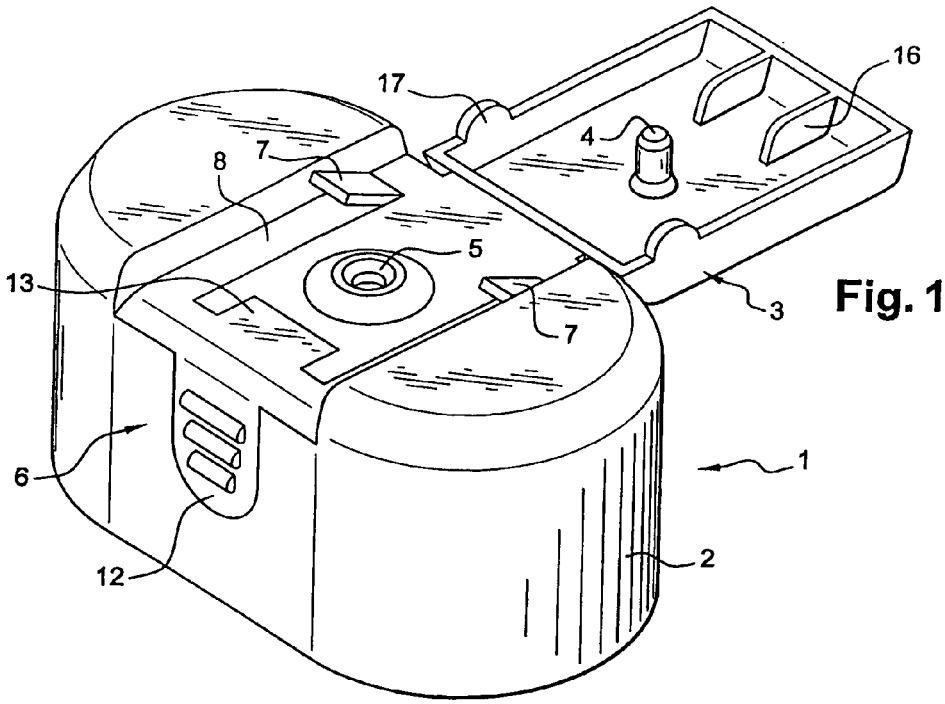
FIG. 1 is a perspective view, in an open position, of an opening-closing device according to the invention, fitted to a stopper known as the service cap of a bottle.
Figure 2:
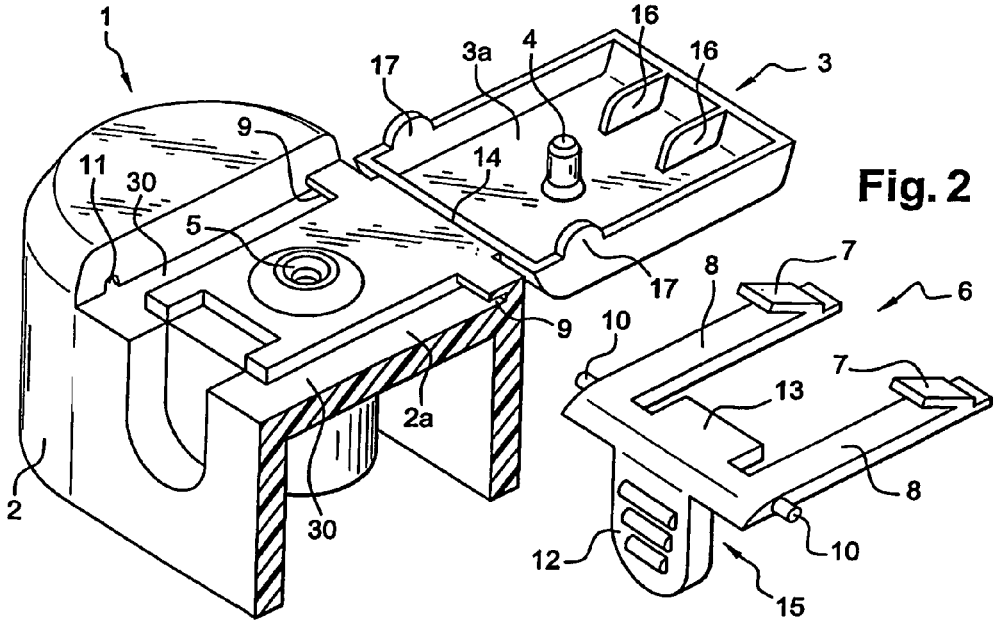
FIG. 2 is an exploded perspective view of two constituent parts of the opening-closing device according to FIG. 1.
Figure 3:
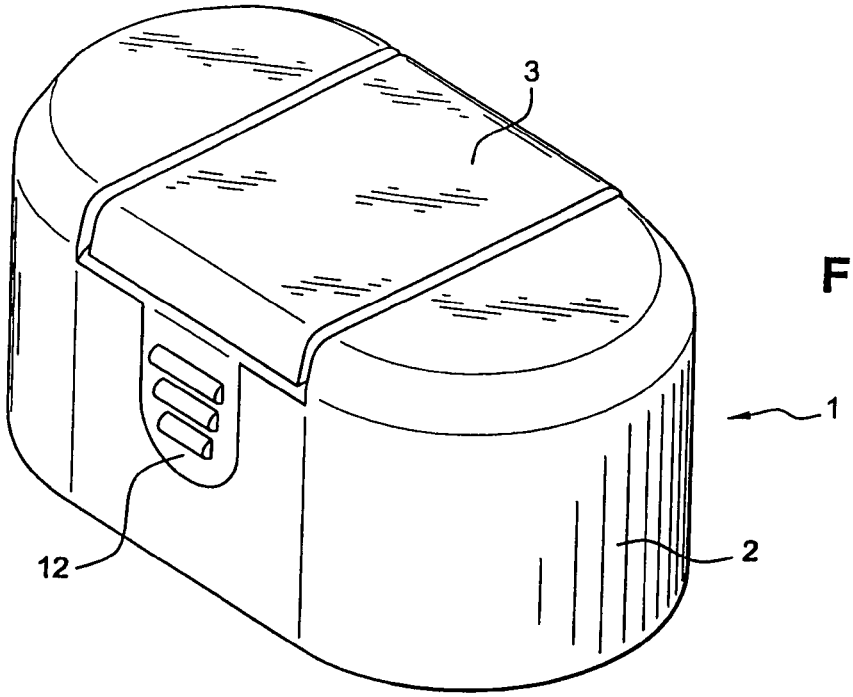
FIG. 3 is a perspective view, in a closed position, of an opening-closing device according to FIGS. 1 and 2.

The opening-closing device denoted 1 overall in FIGS. 1 to 3 consists of a stopper known as the service cap 2 arranged at the end of a bottle (not depicted) to which there is articulated a shut-off flap 3 equipped, in a known way, with an internal peg 4 intended to collaborate in closure with a pouring hole 5 formed at the upper part of the stopper 2 or to be made to open by flipping, said peg also providing sealing at the pouring hole 5. The peg 4 and the hole 5 constitute, according to the present, nonlimiting, example, means for locking the shut-off flap 3.

According to the invention, the shut-off flap 3 comprises controlled-opening means 6, intended to make sure that the shut-off flap 3 flips over fully during opening, with a force of constant magnitude, without manual accompaniment on the part of the user, immediately after this user has exerted a deliberate manual action on the shut-off flap 3 that is confined to releasing its internal peg 4 from the pouring hole 5 in the stopper 2 in which it is held during closure.

According to a first embodiment, the means 6 for the controlled opening of the shut-off flap 3 consist of an energy-storing elastic member 7 inserted between an upper part 2*a* of the stopper 2 and a lower part of the shut-off flap 3 facing one another in closure, so as to keep said member under permanent compression in this position.

More specifically, the energy-storing elastic member 6 consists of two spring leaves 7 that are elastically deformable in one of their free parts, facing upwards and secured to two arms 8, one of the respective ends of which is immobilized in mortises 9 formed on the upper face 2*a* of the stopper 2. Each of the other ends of the arms 8 is equipped with a lateral pivot 10 able to fit in corresponding respective housings 11 formed facing one another on the upper face 2*a* of the stopper 2, in a region away from the region of the mortises 9. Said arms 8 equipped with pivots 10 are joined together by means for releasing the flap 3 which comprise a frontal pressing region 12 of an operating button 15 secured to the pivots 10 and extending downward at right angles to the arms 8 on one side of the articulation formed by said pivots 10. The pressing region 12 is extended toward the inside of the stopper 2, in a plane more or less parallel to the arms, on the other side of said articulation, by a lever 13 able to perform lifting by rotation against an internal part of the free end of the shut-off flap 3 away from the hinge 14 when pressure is exerted on the pressing region 12 of the operating button 15, until such time as the pip 4 is released from the pouring hole 5.

Across its front the stopper 2 comprises a housing, preferably in the shape of a semicircle, for accommodating the pressing region 12 of the operating button 15, while at the same time allowing its travel.

The upper region 2*a* of the stopper 2 comprises two lateral grooves 30 ending in the mortises 9.

According to another feature of the invention, the shut-off flap 3 comprises internal reliefs 16 constituting pressing ridges produced on an internal region 3*a* of said flap 3 at its free end away from the hinge 14, facing that part of the operating button 15 that forms the lever 13, so as to come into contact with the latter on closure.

Moreover, the shut-off flap 3 comprises, on two parallel side walls and near the hinge 14, two bosses 17 opposite the spring leaves 7, constituting points that compress these leaves on closure.

According to another feature of the invention, the operating button 15, the lever 13, the lateral pivots 10, the arms 8 and the spring leaves 7 are obtained as one piece by molding a plastic, with a geometry such as to allow the single component thus formed to be fitted in hollow corresponding parts belonging to the top of the stopper 2, in the manner of a drawer.

As a preference, the plastic used is a polyacetal or a polypropylene filled with long glass fibers, positioned in the lengthwise direction of the spring leaf 7 so as to enhance the spring effect.

According to this embodiment, the spring leaf 7 is overmolded onto the arms 8, but it could very well be forcibly fitted onto these.

Likewise, the stopper 2, the flap 3, the pip 4, the hole 5, the build-in parts 9, the ridges 16, the bosses 17, the articulation holes 11, are made during one single molding operation to form a second one-piece part thus limiting the assembly to two parts to be fitted together.

Assembling the controlled-opening means 6 in the stopper 2 is performed by inserting the arms 8 into the grooves 30 in the stopper 2, which arms then position themselves in the housings 9 and 11.

In order to open the shut-off flap 3, once these two parts have been assembled, all that is required is for pressure to be exerted on the pressing region 12. That causes the lever 13 to rotate about the pivot region 10; this pivoting part then presses against the pressing ridges 16 of the flap 3.

The movement of the pressing ridges means that the pip 4, situated on the flap 3, is no longer held in the product outlet hole 5.

The spring leaves 7, as they release, push on the bosses 17 of the shut-off flap 3 and thus allow automatic opening of the flap 3.

Closure is performed by pushing the flap 3 back onto the cap 2, the pip 4 then becomes held in the product outlet hole 5 and the bosses 17 once again compress the spring leaves 7, ready for the next opening.

Figure 4:
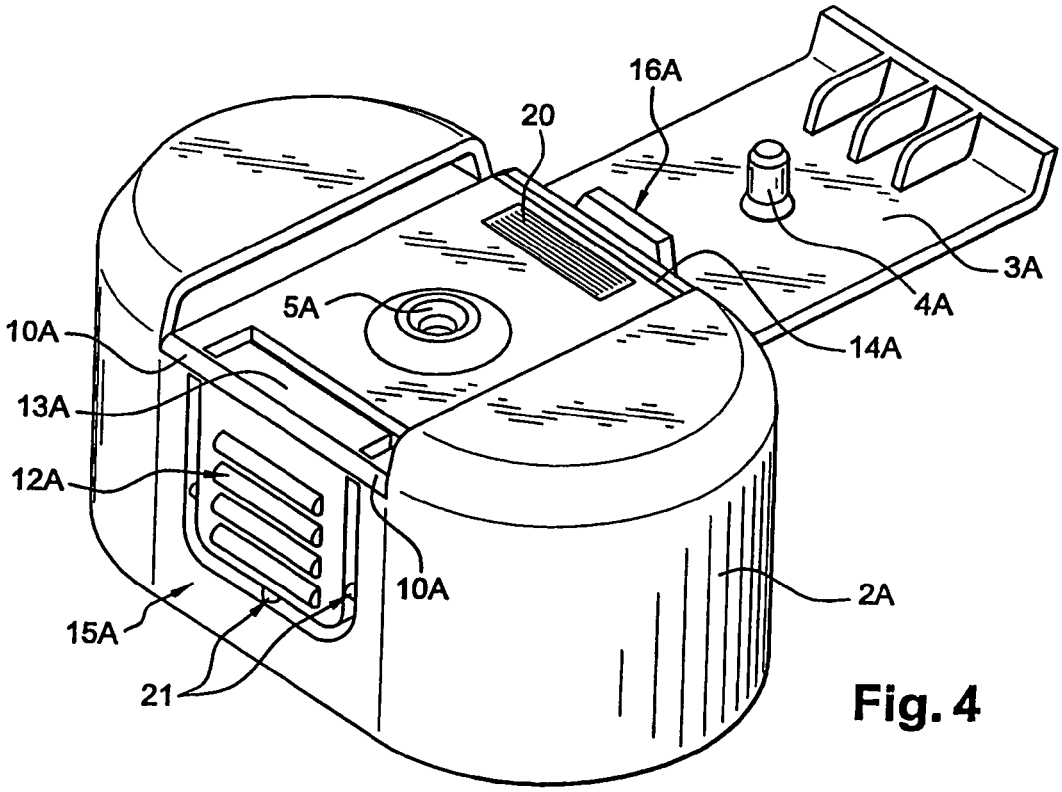
FIG. 4 is a perspective view of an opening-closing device according to a second embodiment.

According to an alternative form of embodiment depicted in FIG. 4, the energy-storing elastic member 20 consists of a block of elastically deformable elastomer inserted into an upper region of the stopper 2A near the hinge 14A so as to collaborate, in crushing, when the flap 3A is in a closed position, with a rib 16A produced in a corresponding internal region of the latter.

According to another feature of this second embodiment depicted in FIG. 4, the stopper 2A comprises means for releasing the shut-off flap which comprise a frontal pressing region 12A of an operating button 15A, secured to two lateral pivots 10A able to be articulated in two corresponding housings. Said pressing region 12A is extended at its upper part, beyond the articulation formed by the pivots 10*a*, towards the inside of the stopper 2A, by a lever 13A more or less perpendicular to the pressing region 12A and able to perform lifting by rotation against an internal part of the free end of the shut-off flap 3A away from the hinge 14A when pressure is exerted on the pressing region of the operating button 15A, until such time as the pip 4A is released from the pouring hole 5A.

As before, the shut-off flap 3A comprises internal reliefs 16A constituting pressing ridges produced on an internal region of said flap 3A at its free end away from the hinge 14A, facing that part of the operating button 15A that forms the lever 13A, so as to come into contact with the latter on closure.

Again, as before, the operating button 15A consisting of the pressing region 12A, the pivots 10A and the lever 13A is obtained in one piece in a single operation of molding a plastic.

According to another feature of the invention which is common to both embodiments, interposed the frontal pressing region 13, 13A of the operating button 15, 15A and its corresponding housing formed in the stopper 2, 2A are indicators 21 indicating first opening.

The invention claim is:

1. A device for opening-closing a container having a stopper arranged at an end and to which there is articulated a shut off flap equipped with a locking system and which collaborates in sealed closure with a hole formed at an upper part of the stopper or is made to open by flipping, said shut off flap comprising controlled opening means including an energy storing elastic member inserted between an upper part of the stopper and a lower part of the shut off flap, and formed by two spring leaves that are elastically deformable, wherein free parts of the spring leaves are secured to two arms, one of the respective ends of which is immobilized in mortises formed on the upper part of the stopper and each of the other ends of which is equipped with a lateral pivot able to fit in corresponding respective housings formed facing one another on the upper part of the stopper, in a region away from the region of the mortises, said arms being equipped with pivots being joined together by means for releasing the flap which comprises a frontal pressing region of an operating button secured to the pivots and extending downward at right angles to the arms on one side of the articulation formed by said pivots and extending towards an inside of the stopper, in a plane more or less parallel to the arms, on the other side of said articulation, by a lever able to perform lifting by rotation against an internal part of the free end of the shut off flap away from a hinge when pressure is exerted on the pressing region of the operating button, until such time as a pip is released from the hole.

2. The opening closing device as claimed in claim 1, wherein the shut off flap comprises internal reliefs constituting pressing ridges produced on an internal region of said flap at its free end away from the hinge, facing that part of the operating button that forms the lever, so as to come into contact with the latter on closure.

3. The opening closing device as claimed in claim 1, wherein the shutoff flap comprises, on two parallel side walls and near the hinge, two bosses opposite the spring leaves, constituting points that compress the leaves on closure.

4. The opening closing device as claim in claim 1, wherein the operating button, the lever, the lateral pivots, the arms and the spring leaves are created as one piece by molding a plastic, with a geometry such as to allow a single component thus formed to be fitted in hollow corresponding parts belonging to a top of the stopper, in the manner of a drawer.

5. The opening closing device as claimed in claim 1, wherein interposed between the frontal pressing region of the operating button and its corresponding housing formed in the stopper are indicators indicating first opening.

* * * * *

UNITED STATES PATENT AND TRADEMARK OFFICE

CERTIFICATE OF CORRECTION

PATENT NO. : 7,651,002 B2
APPLICATION NO. : 10/535365
DATED : January 26, 2010
INVENTOR(S) : Hennemann et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1288 days.

Signed and Sealed this

Twenty-eighth Day of December, 2010

David J. Kappos

David J. Kappos
*Director of the United States Patent and Trademark Office*